US006886529B2

(12) United States Patent
Suzuki et al.

(10) Patent No.: US 6,886,529 B2
(45) Date of Patent: May 3, 2005

(54) ENGINE CONTROL DEVICE FOR WATER VEHICLE

(75) Inventors: Akitaka Suzuki, Shizuoka (JP); Shigeharu Mineo, Shizuoka (JP); Hitoshi Motose, Shizuoka (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 26 days.

(21) Appl. No.: 10/331,452

(22) Filed: Dec. 27, 2002

(65) Prior Publication Data

US 2003/0140894 A1 Jul. 31, 2003

(30) Foreign Application Priority Data

Jan. 29, 2002 (JP) ..... 2002-020047

(51) Int. Cl.[7] ..... F02D 9/00
(52) U.S. Cl. ..... 123/342; 123/400; 440/88 A
(58) Field of Search ..... 123/342, 198 D, 123/198 F, 399, 400; 440/32, 88 A, 900

(56) References Cited

U.S. PATENT DOCUMENTS 5,062,401 A 11/1991 Suganuma
5,325,832 A * 7/1994 Maute et al. ..... 123/396
5,584,266 A 12/1996 Motose et al.
5,593,330 A 1/1997 Kobayashi
5,669,349 A 9/1997 Iwata et al.
5,720,257 A 2/1998 Motose et al.
5,826,557 A 10/1998 Motoyamah et al.
5,921,217 A * 7/1999 Koike et al. ..... 123/335
5,970,951 A 10/1999 Ito
6,019,090 A * 2/2000 Ozawa ..... 123/481
6,196,188 B1 * 3/2001 Janic et al. ..... 123/350
6,276,333 B1 * 8/2001 Kazama et al. ..... 123/399
6,298,824 B1 * 10/2001 Suhre ..... 123/406.49
6,612,881 B2 * 9/2003 Kanno ..... 440/1
6,695,657 B2 * 2/2004 Hattori ..... 440/84

FOREIGN PATENT DOCUMENTS

JP A-H11-059572 3/1999

OTHER PUBLICATIONS

U.S. Appl. No.: 10/068,357 filed on Feb. 5, 2002. Title: Engine Control Unit for Water Vehicle. Inventors: Hiki et al.

* cited by examiner

*Primary Examiner*—Hai Huynh
(74) *Attorney, Agent, or Firm*—Knobbe, Martens, Olson & Bear, LLP

(57) ABSTRACT

A watercraft includes an engine output control device that can adjust the maximum output of the engine. The output device can be constructed of mechanical devices for adjusting the relationship between the movement of a throttle lever and a throttle valve, an electronic device for proportionally controlling the position of throttle valves in relation to the movement of the throttle lever, are other devices for controlling engine speeds in other ways.

10 Claims, 6 Drawing Sheets

ENGINE CONTROL DEVICE FOR WATER VEHICLE

PRIORITY INFORMATION

This application is based on Japanese Patent Application No. 2001-263768, filed Aug. 31, 2001, and is also based on and claims priority to Japanese Patent Application No. 2002-020047 filed Jan. 29, 2002, the entire contents of both of which are hereby expressly incorporated by reference.

BACKGROUND OF THE INVENTION

1. Field of the Invention

The present invention generally relates to a control device for an engine. More specifically, the present invention relates to an engine power output control device for the engine of the watercraft.

2. Description of the Related Art

As personal watercraft have become popular, they have become increasingly fast. Today, certain personal watercrafts are capable of speeds greater than 60 miles per hour. To attain such speeds, these personal watercrafts are driven by high power output motors.

Typically, two-cycle engines are used in personal watercraft because two-cycle engines have a fairly high power-to-weight ratio. One disadvantage of two-cycle engines, however, is that they produce relatively high emissions. In particular, vast amounts of carbon monoxide and hydrocarbons are produced during operation of such an engine. Once steps are taken to reduce these emissions, other undesirable consequences typically result, such as an increase in the weight of the engine, the cost of manufacture, and/or the reduction of power.

It has been suggested that four-cycle engines replace two-cycle engines in personal watercraft. Four-cycle engines typically produce less hydrocarbon emissions than two-cycle engines while still producing a relatively high power output. Additionally, it has been suggested that fuel injected engines are more efficient and cleaner.

SUMMARY OF THE INVENTION

One aspect of at least one of the inventions disclosed herein includes the realization that often times, riders of personal watercraft wish to drive the watercraft at a speed that is less than the maximum speed of the watercraft. Typically, personal watercraft include a finger-operated throttle lever on one of the handlebar grips. Thus, in order to operate the personal watercraft at a speed that is less than the maximum speed, the operator must hold the throttle lever at a midway position, for example, with one finger, yet retain a sufficiently firm grasp of the handlebars with the remaining fingers. Operating a watercraft in such a manner can cause some discomfort. Thus, it is desirable to allow the watercraft to operate at a speed lower than the maximum speed of the watercraft, yet with the throttle lever in a fully depressed position. As such, the operator can use all fingers to more comfortably grasp the handlebar.

In accordance with one embodiment of at least one of the inventions disclosed herein, a watercraft comprises a hull. The hull defines an operator's area. An engine output request device is disposed in the operator's area and is movable between a minimum position and a maximum position. An engine is supported by the hull. The engine includes an engine body defining at least one combustion chamber therein. An air amount control device is configured to control an amount of air flowing into the combustion chamber and is operable in at least first and second modes. The air amount control device is configured to, in the first mode, allow a maximum amount of air to flow into the combustion chamber when the engine output request device is positioned in the maximum position. Additionally, the air amount control device is configured to, in the second mode, allow an amount of air less than the maximum amount, when the engine output request device is positioned in the maximum position.

In accordance with another embodiment of at least one of the inventions disclosed herein, a method of regulating the output of an engine comprises receiving engine output requests between minimum and maximum magnitudes, controlling a flow of air into a combustion chamber of the engine in accordance with the engine output requests and, in a first mode, allowing a maximum amount of air to flow to the combustion chamber in response to a maximum magnitude engine output request. In a second mode, the method includes preventing the maximum amount of air from flowing to the combustion chamber in response to a maximum magnitude engine output request.

In accordance with yet another embodiment of at least one of the inventions disclosed herein, an internal combustion engine comprises an engine body defining at least one combustion chamber therein, an engine output request device, a control device configured to control an amount of air flowing into the combustion chamber based on a signal from the engine output request device, and means for changing the relationship between a maximum signal from the engine output request device and a maximum amount of air flowing into the combustion chamber.

BRIEF DESCRIPTION OF THE DRAWINGS

These and other features, aspects, and advantages of the present inventions will now be described with reference to the drawings of preferred embodiments, which are intended to illustrate and not to limit the inventions, and in which figures.

DETAILED DESCRIPTION OF THE PREFERRED EMBODIMENT

Figure 1:
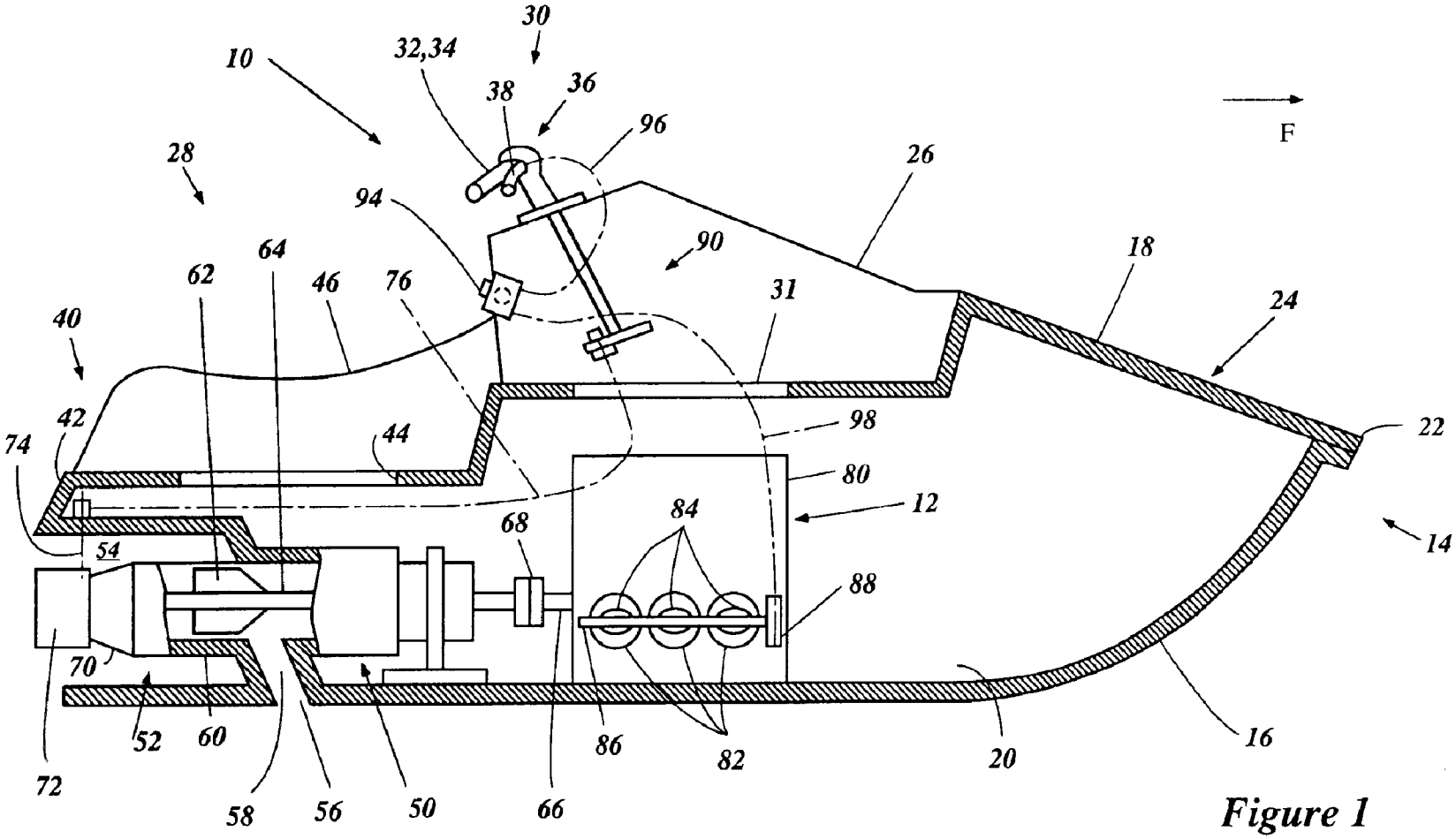
FIG. 1 is a partial sectional and side elevational view of a watercraft constructed in accordance with at least one of the inventions disclosed herein, with certain components such as an engine and a jet-propulsion device shown inside the watercraft.
Figure 2:
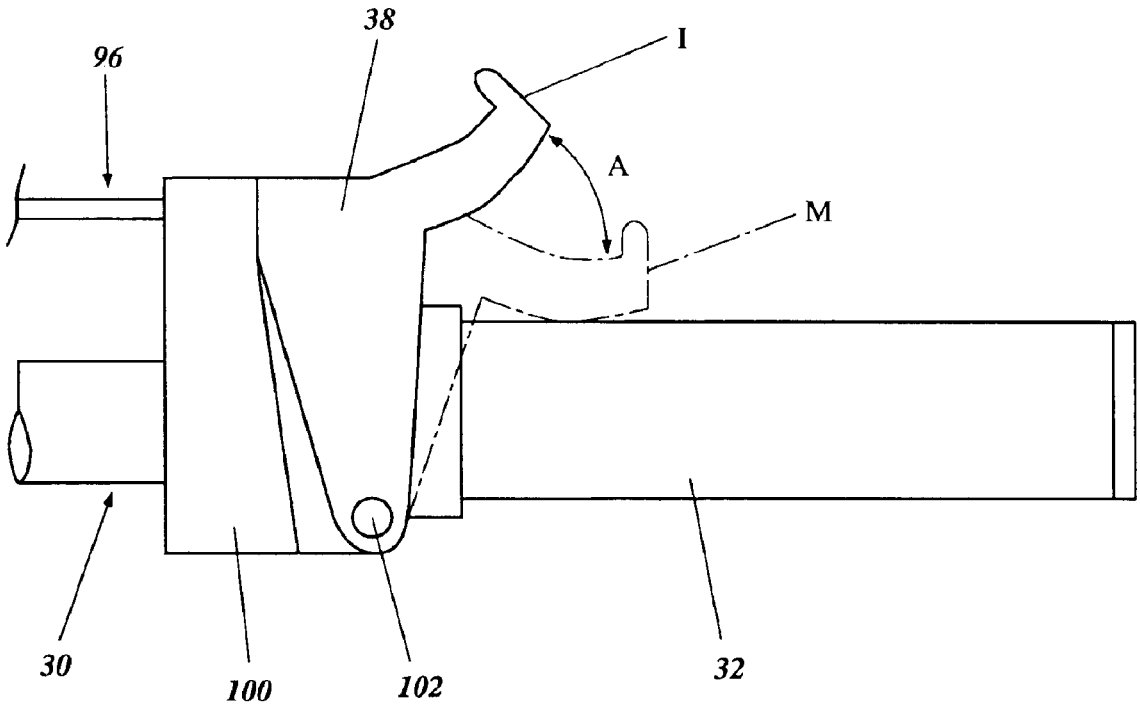
FIG. 2 is an enlarged top plan view of a starboard side handlebar grip and throttle lever included on the watercraft illustrated in FIG. 1.

With reference to FIGS. 1 and 2, an overall description of a personal watercraft 10 is set forth below. An arrow F shown in FIG. 1 indicates a forward direction of travel of the watercraft 10.

The watercraft 10 includes an engine 12 in the hull 14. The hull 14 includes a lower hull section 16 and an upper deck section 18. Both of the hull sections 16, 18 may be constructed of, for example, a molded fiberglass reinforced resin or a sheet molding compound. The hull sections 16, 18 may, however, be constructed from a variety of other materials selected to make the watercraft lightweight and buoyant. The lower hull section 16 and the upper hull section 18 are coupled together to define an internal cavity 20. The hull sections 16, 18 are coupled together along a bond flange 22.

The hull 14 extends longitudinally and thereby generally defines a longitudinal axis (not shown). Along the longitudinal axis, from a forward portion of the watercraft 10 to a rearward portion, the watercraft 10 includes a bow portion 24, a control mast 26 and a rider's area 28.

In the illustrated embodiment, the bow portion 24 of the upper hull section 18, slopes upwardly. Preferably, an opening (not shown) is formed in the valve portion 24 and is closed with a hinged hatch cover (not shown).

The control mast 26 extends upwardly from the bow portion 24 to support a handlebar 30. In the illustrated embodiment, the portion of the upper hull section 18 includes an access opening 31 under the control mast 26 and above the engine 12. In this embodiment, the control mast 26 can be hinged to the upper hull section 18, so as to allow the access opening 31 to be opened and closed by movement of the control mast 26 about such a hinged connection. Preferably, the control mast 26 substantially seals the access opening 31 when closed over the opening 31.

The handlebar 30 includes starboard and port side grips 32, 34 which are spaced apart and arranged to be grasped by an operator seated in the rider's area 28. The handlebar 30 is provided primarily for controlling the direction in which the watercraft 10 travels.

The grips 32, 34 are formed at both ends of the handlebar 30 to aid the rider in controlling the direction of travel, and maintaining his or her balance on the watercraft 10. The handlebar 30 also carries other control devices such as, for example, an engine output request device 36. In the illustrated embodiment, the engine output control device 36 is a throttle lever 38, described in greater detail below.

The rider's area 28 is defined primarily by a seat assembly 40. The seat assembly 40 is formed by a seat pedestal 42 which is defined by a portion of the upper hull section 18. The pedestal 42 extends longitudinally along the hull in a shape that can be straddled by rider. Additionally, the pedestal 42 includes an access opening 44 through which a user can access another portion of the internal cavity 20.

The seat assembly 40 also includes the seat cushion 46 which is supported by the pedestal 42. Preferably, the seat cushion 46 substantially seals the access opening 44 when installed on the pedestal 42 so as to prevent water from entering the internal cavity 20. Additionally, foot areas (not shown) are formed on each side of the seat assembly 40.

Preferably, the watercraft 10 includes at least one ventilation duct (not shown) for allowing atmospheric air to flow into the internal cavity as well as allowing air from inside the internal cavity to flow out to the atmosphere. Except for the ventilation ducts, the internal cavity 20 is substantially sealed during operation so as to prevent water from invading into the internal cavity 20.

The watercraft 10 also includes a propulsion device 50, which is driven by the engine 12 and generates a thrust to propel the watercraft across a body of water in which the watercraft 10 is operating. In the illustrated embodiment, the propulsion device is a jet pump 52. The jet pump 52 is mounted at least partially within a tunnel 54 formed on an underside of the lower hull section 16. The tunnel 54 has a downwardly facing inlet 56 which opens toward a body of water which the watercraft 10 is operating. A duct extends upwardly from the inlet 56 and forms a gullet 58 leading to the interior of a jet pump housing 60. An impeller 62 is supported within the housing 60.

An impeller shaft 64 extends forwardly from the impeller 62 and is connected to an output shaft 66 of the engine 12. A flexible coupling 68 connects the upper shaft 66 to the impeller shaft 64.

A rear end of the housing 60 defines a discharge nozzle 70. A steering nozzle 72 is affixed to the discharge nozzle 70 pivotally from movement about a steering axis 74 which extends generally vertically. The steering nozzle 72 is connected to the handlebar 30 to a Bowden-wire assembly 76, for example, so that the rider can pivot the steering nozzle 72.

As the engine 12 drives the output shaft 66, and thus the impeller shaft 64, the impeller 62 is thereby rotated within the housing 60. The pressure generated in the housing 60 by the impeller 62 produces a jet of water that is discharged through the discharge nozzle 70 and through the steering nozzle 72. This water jet propels the watercraft 10 in a forward direction, as indicated by the arrow F. The rider can move the steering nozzle 72 with the handlebar 31 if he or she desires to turn the watercraft 10.

Preferably, the watercraft 10 also includes a reverse bucket (not shown). Such a reverse bucket can be pivotally mounted relative to the discharge nozzle 70 so as to pivot about a generally horizontal axis. The reverse bucket can be shaped such that when it is placed in its fully downward position, water discharge from the nozzle 70 is turned downwardly and forwardly so as to generate a reverse thrust, moving the watercraft 10 rearwardly. In its upright position, the reverse bucket allows the water to be discharged rearwardly from the discharge nozzle 70, thereby resulting in a forward thrust.

The engine 12 can be configured to operate on any combustion principle, such as, for example, but without limitation, four stroke, two stroke, rotary, diesel, etc. Most commonly, personal watercraft include either a two-stroke or a four-stroke engine. In the illustrated embodiment, the engine 12 operates on a two-stroke combustion principle.

The engine 12 includes a cylinder block which defines at least one cylinder bore therein. In the illustrated embodiment, the cylinder block includes three cylinder bores spaced from each other along the longitudinal axis of the watercraft 10. The illustrated engine 12, however, merely exemplifies one type of engine that may include preferred embodiments of the engine control system of the present application. Engines having other numbers of cylinders, have another cylinder arrangements, and other cylinder orientations (e.g., upright cylinder banks, V-type, and W-type) are all practicable.

A piston (not shown) is slidably disposed in each cylinder bore. The cylinder head member is affixed to the upper end of the cylinder block. The cylinder head member closes the upper ends of the cylinder bores and defines three combustion chambers along with respective cylinders bores and pistons.

A crankcase member (not shown) is affixed to the lower end of the cylinder block to close the respective lower ends of the cylinder bores and the crankcase chamber. A crankshaft is rotatably connected to the pistons through connecting rods and is supported within the crankcase. Additionally, the crankcase includes seals separating the crankcase into three compartments, one for each of the cylinder bores.

The cylinder block, the cylinder head member, and the crankcase member, together define an engine body 80. The engine body 80 preferably is made of an aluminum-based alloy. In the illustrated embodiment, the engine body 80 is arranged in the internal cavity 20 so as to position the output shaft 66 parallel to the longitudinal axis of the watercraft 10. Other orientations of the engine body 80, of course, are also possible (e.g., with a transverse or vertical crankshaft).

Additionally, the output shaft 66 can also be formed with one end of the crankshaft of the engine 12, or can be an additional shaft connecting the crankshaft to the coupling 68. Further, where the engine 12 is a four-stroke engine, the watercraft 10 preferably includes a gear-reduction set for reducing the rotational speed of the output shaft 66 relative to the crankshaft of the engine 12. Thus, in this configuration, the engine 12 can operate at higher rpm than that of the impeller 62.

The engine 12 also includes an air induction system configured to guide air to the combustion chambers therein. Preferably, the air induction system includes features for preventing water that may be within the internal cavity 20, from entering the induction system.

In the illustrated embodiment, the induction system includes a throttle body 82 for each of the three cylinders within the engine body 80. Each throttle body 82 includes a butterfly-type throttle valve 84. Each of the throttle valves 84 comprise a plate member which defines the butterfly-type valve with an interior surface of the throttle bodies 82. A throttle valve shaft 86 extends through all of the throttle bodies 82 to rotatably support each throttle valve 84.

A throttle valve pulley 88 is rotatably connected to the throttle valve shaft 86. A throttle cable arrangement 90 connects the throttle valve pulley 88 to a throttle lever 38, so as to allow the operator to control an opening amount of the throttle valves 84, discussed in greater detail below with reference to FIGS. 2–6.

It is to be noted that the induction system can be configured with only one throttle body 82 and one throttle valve 84. Additionally, it is to be noted that the throttle valve shaft 86 can be controlled using a steppermotor which is controlled with an electronic signal.

In operation, the engine 12 draws air from the internal cavity 20 into the combustion chambers within the engine during upward movement of the pistons within the engine body 80. The throttle valves 84 meter the amount of air flowing the throttle bodies 82 and thus into the engine body 80. When the throttle valves 84 are closed, only a small amount of air enters the engine body 80. Preferably, the throttle valves 84 are configured to allow a predetermined amount of air to flow through the throttle bodies 82 when the throttle valves 84 fully closed, to thereby allow the engine 12 to operate at an idle speed. Alternatively, one or a plurality of idle air passages (not shown) can be configured to allow an idle amount of air to bypass the throttle valves 84 and flow into the engine body 80 during idle-speed operation.

The engine 12 also includes an exhaust system configured to guide burnt fuel charges from the engine body 80 to the atmosphere. Exhaust gases are discharged from the combustion chambers within the engine body 80 during the downward movement of the pistons. The exhaust gases travel out of the combustion chambers, through exhaust ports disposed on a side of the cylinder bores. The exhaust gases then travel through one or more of a plurality of exhaust pipes, mufflers, and other components to the atmosphere. Preferably, the engine 12 also includes sliding knife-type exhaust valves for controlling the timing at which the exhaust ports open and close.

Figure 6:
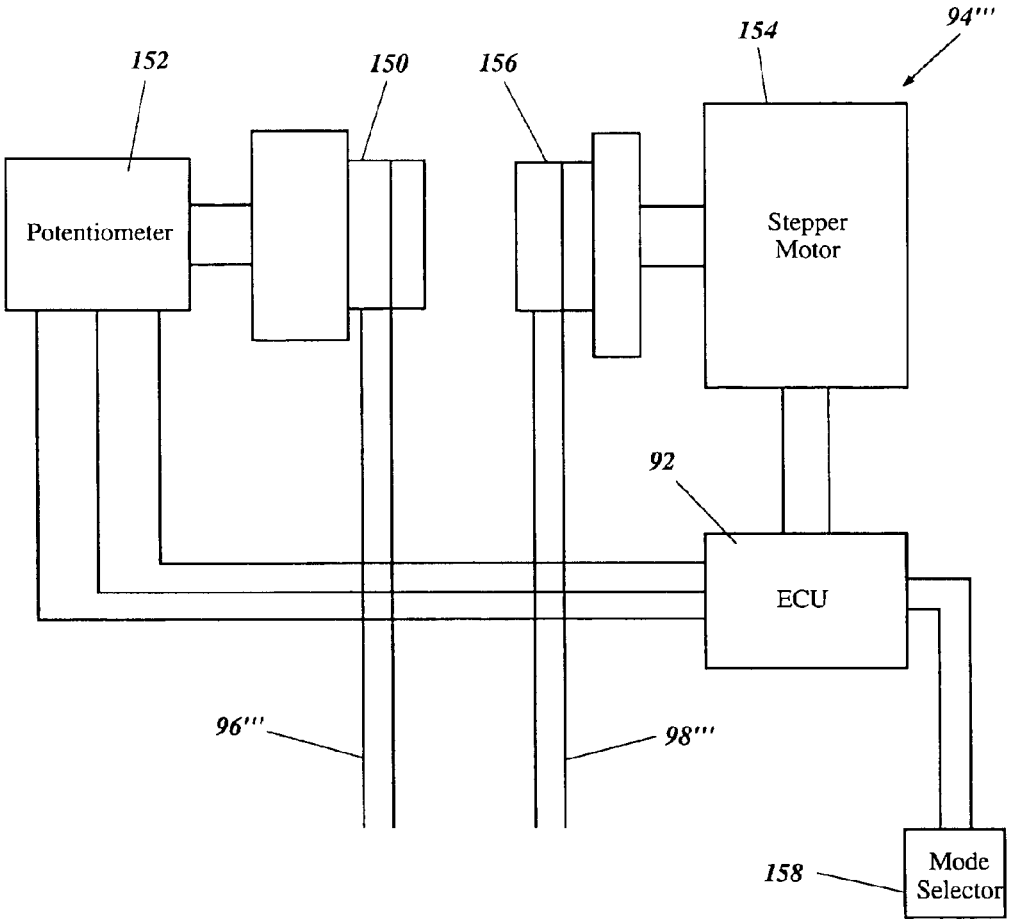
FIG. 6 is a schematic illustration of yet another modification of the engine output control device illustrated in FIG. 5.

The engine 12 also includes a fuel delivery system (not shown). The fuel delivery system can be in a form of a conventional induction passage fuel injection system, a semi-direct fuel injection system, a direct fuel injection system, or a carburetion system. Where the fuel delivery system is carburetion or conventional fuel injection, the fuel injectors or carburetors can be incorporated with the throttle bodies 82.

Where the fuel delivery system is a fuel injection system, the timing and duration of fuel injection from associated fuel injectors are controlled by an electronic control unit (ECU) 92 (FIG. 6). Preferably, each of the fuel injectors are controlled by an electronic solenoid (not shown) which opens a valve at the discharge end of the fuel injectors. The ECU 92 communicates with the solenoids through communication lines. Thus, the ECU 92 signals the solenoids to open according to a timing and duration determined by the ECU 92.

Where the fuel delivery system is a carbureted system, the amount of fuel added to the induction air is typically controlled by the velocity of induction air flowing through an venturi nozzle disposed in the carburetor. However, more recently, there has been proposed designs for new carburetors which include electronically-controlled devices for controlling an amount of fuel added to the induction air by the carburetor. For example, a carburetor can have electronically controlled jets as well as additional throttling devices for controlling an air flow velocity through the venturi nozzle.

The engine 12 also includes an ignition system (not shown). The ignition system includes at least one spark plug (not shown) for each of the combustion chambers disposed in the engine body 80. The spark plugs are mounted such that no electrode of the spark plug is exposed to respective combustion chamber. The spark plugs ignite an air fuel charge, which is formed by the combination of air and fuel generated by the induction and fuel delivery systems, at a timing determined by the ECU 92, so as to cause the air fuel charge to bound therein. For this purpose, the ignition system includes an ignition coil interposed between the spark plugs and the ECU 92. The ECU 92 controls the operation of the coil through a control line.

As noted above, the ECU 92 controls engine operations including the firing of the spark plugs, and optionally the fuel delivery performed by the fuel delivery system, according to various control maps stored in the ECU 92. In order to determine appropriate control scenarios, the ECU 92 utilizes such maps into indices stored within the ECU 92 in reference to data quoted from various centers. Optionally, the ECU 92 can be configured to control the movement of the throttle valves 84, discussed in more detail below.

Any type of desired control strategy can be employed for controlling the timing of the firing of the spark plugs and, optionally, the timing and duration of fuel injection from fuel injectors where a fuel injection system is employed, or the amount of fuel delivered by electronically-controlled carburetors. Typically, fuel supply control strategies are configured to create stochiometeric metric air fuel charges in a combustion chamber. Additionally, the watercraft 10 preferably includes a rev-limiter configured to limit the speed of the engine to a speed that prevents damage to the engine 12. It should be understood, however, that those skilled in the art will readily understand how various control strategies can be employed in conjunction with components of the present inventions.

Where the air fuel ratio of the air fuel charges is electronically controlled, the ECU 92 preferably defines at least a portion of the feedback control system. Thus, the combustion condition sensors, such as an oxygen sensor can be mounted so as to detect residual amounts of oxygen in the combustion products approximately at the time when the exhaust valves open. An air fuel data line connects such a sensor to the ECU 92, and thus can transmit a signal indicative of the air fuel ratio to the ECU 92.

The watercraft 10 can also include an engine speed sensor (not shown) configured to detect a speed of the crankshaft and to produce a signal indicative of the speed of rotation of the crankshaft. An engine speed data line connects the sensor to the ECU 92.

These sensed conditions disclosed above are merely some of those conditions which may be sensed and applied for control of ignition and/or fuel injection. It is, of course, practical to provide other sensors such as, for example, a crank angle position sensor, an engine temperature sensor, a fuel level sensor, an intake air pressure sensor, an intake air temperature sensor, a throttle position sensor, a knock sensor, a pitch sensor, an atmospheric temperature sensor, an atmospheric pressure sensor, a fuel pressure sensor, etc., in accordance with the various control strategies that can be employed.

The watercraft 10 also includes an engine output control device 94 which is configured to control an output of the engine 12 based on an output of the engine output request device. As illustrated in FIG. 1, the engine output control device 94 is connected to the throttle lever 38 through an engine output request line 96. Additionally, the engine output control device 94 is connected to the throttle shaft pulley 88 through an engine output control line 98.

FIG. 2 is an enlarged top plan view of the starboard handlebar grip 32 in the engine output request device connected thereto. As noted above, in the illustrated embodiment, the engine output request device is a throttle lever 38.

A base member 100 is firmly attached to the handlebar 38 adjacent to the grip 32. A pivot 102 is mounted to the base member 100. The throttle lever 38 is pivotally mounted to the pivot 102 so as to move between an idle position, indicated by the letter "I" in a maximum position, indicated by the letter "M." The range of movement between the arrow position in the maximum position is indicated by the arc "A."

In the illustrated embodiment, the throttle lever 38 is configured to be grasped by one or two fingers. Thus, when an operator is holding the throttle lever at the idle position I or any position between the idle position I and the maximum position M, the operator will use one or two fingers to hold the throttle lever 38 at a position spaced from the grip 32. The remaining fingers of the operator's right hand can be wrapped around the grip 32. In such a position, the operator can experience discomfort if an intermediate position (not shown) is held for a long period of time.

With reference to FIG. 1, the engine output control device 94 is configured to change the relationship between the output of the engine output request device and the amount of air allowed to flow into the combustion chambers of the engine 12. Thus, the engine output control device 94 includes at least two modes of operation. The first mode of operation can be referred to as a normal mode of operation. In the normal mode, the device 94 can be configured to move the throttle shaft pulley 88 between its idle (minimum or fully closed position) and its maximum opening position (e.g., "full throttle") in accordance with a movement of the throttle lever 38 between the idle position I and the maximum position M (FIG. 2), respectively.

In the illustrated embodiment, the engine output control device 94 is constructed as a mechanical device receiving an input from the request device cable 96 and transmitting an output to the throttle valve shaft pulley 88 through the output throttle cable 98. In this embodiment, the engine output control device includes an input pulley 100 and an output pulley 102.

The input pulley 100 is shaped to have only one diameter. The input pulley 100 is connected to the output pulley 102 by a shaft 104, such that the input pulley 100 and the output pulley 102 rotate together.

The output pulley 102 includes a first diameter portion 106 and a second diameter portion 108. The first diameter portion 106 has essentially the same diameter as the input pulley 100. The second diameter portion 108 has a diameter that is smaller than that of the first diameter portion 106.

The other surfaces of the pulleys 100, 102 each include at least one connector or other surface feature for engaging a portion of the cables 96, 98, respectively. Thus, when the input cable 96 is pulled by the throttle lever 38, the input pulley 100 rotates accordingly. Additionally, the input pulley 100 rotates the output pulley 102 through the shaft 104. Thus, the output cable 98 is pulled by the output cable 102, thereby rotating the throttle valve shaft 86, which thereby changes the opening amount of the throttle valves 84.

Because the diameter of the input pulley 100 and the first diameter portion 106 of the output pulley 102 have essentially the same diameter, there is a 1:1 ratio between the amount of movement of the input cable 96 to the amount of movement of the output cable 98 when the output cable is engaged with the first diameter portion 106. Accordingly, the throttle lever 38 and the throttle shaft pulley 88 are configured such that in this normal operation mode, the movement of the throttle valve 38 from the idle position I to the maximum position M (FIG. 2) causes the throttle shaft pulley 88 to move correspondingly from an idle position to a maximum position.

The engine output control device 94 also includes a switch (not shown) configured to change the location of the engagement of the output cable 98 to the output pulley 102. For example, the switch can be configured to move the pulley 102 or the cable 98 such that when the engine output control device 94 is changed from a normal mode to a regulated mode, the output cable 98 engages the second diameter portion 108. It is conceived that the second diameter portion 108 can include only one area for engaging the output cable 98, a plurality of predetermined positions, or can be configured to continuously change the location of engagement providing essentially infinite adjustment.

Because the diameter(s) provided by the second diameter portion 108 are less than the diameter of the input pulley 100, the ratio of movement of the input cable 96 to the movement of the upper cable 98 changes in accordance with the location of engagement of the output cable 98 with the second diameter portion 108. Thus, when the engine output control device 94 is operated in a regulation mode, and the output cable 98 engages the second diameter portion 108, movement of the throttle valve 38 from the idle position I to the maximum position M will result in a reduced magnitude of movement of the throttle shaft pulley 88. Thus, when the throttle valve 38 is held in the maximum position M, the throttle shaft pulley 88 is held at an intermediate position between the idle position and the maximum or "wide-open throttle" position.

Preferably, the engine output control device 94 includes a user-operable switch for changing the device 94 between a normal operation mode and a regulated operation mode. Thus, a user can choose to set the engine output control device 94 so that a full throttle or maximum position M of the throttle lever 38 results in an engine speed that provides a cruising speed of the watercraft 10 that is less than the maximum speed of the watercraft 10. As such, a user or operator can maintain a grip on the handlebar grip 32 with all of their fingers in a fully contracted manner which is more comfortable than a position in which one or two fingers are held in an intermediate position. As such, the engine output control device 94 can allow the input received from the engine output request device to be communicated, without modification, to the engine 12, allowing the engine to reach maximum speed in accordance with movement of the engine upper request device, or the engine output control device can be set in a mode which attenuates the transmission of the input from the engine output request device to the engine 12.

Optionally, the engine output control device 94 can be in the form of a steppermotor and associated driver electronics. In this modification, the engine output request device can be in the form of a throttle lever, such as the throttle lever 38, connected to an electronic converter configured to convert the physical movement of the throttle lever 38 to an electronic signal. The driver electronics (not shown) can be configured to receive the signal from the throttle lever and move the throttle shaft 86 in proportion to the movement of the throttle valve 38.

Additionally, these electronics can allow the operator of the watercraft 10 to choose between a normal mode of operation and a regulated mode of operation. In such a normal mode of operation, the steppermotor will move the throttle valves from an idle position to a wide-open throttle position in accordance with the movement of the throttle valve 38 from an idle position I to a maximum position M (FIG. 2).

Figure 3:
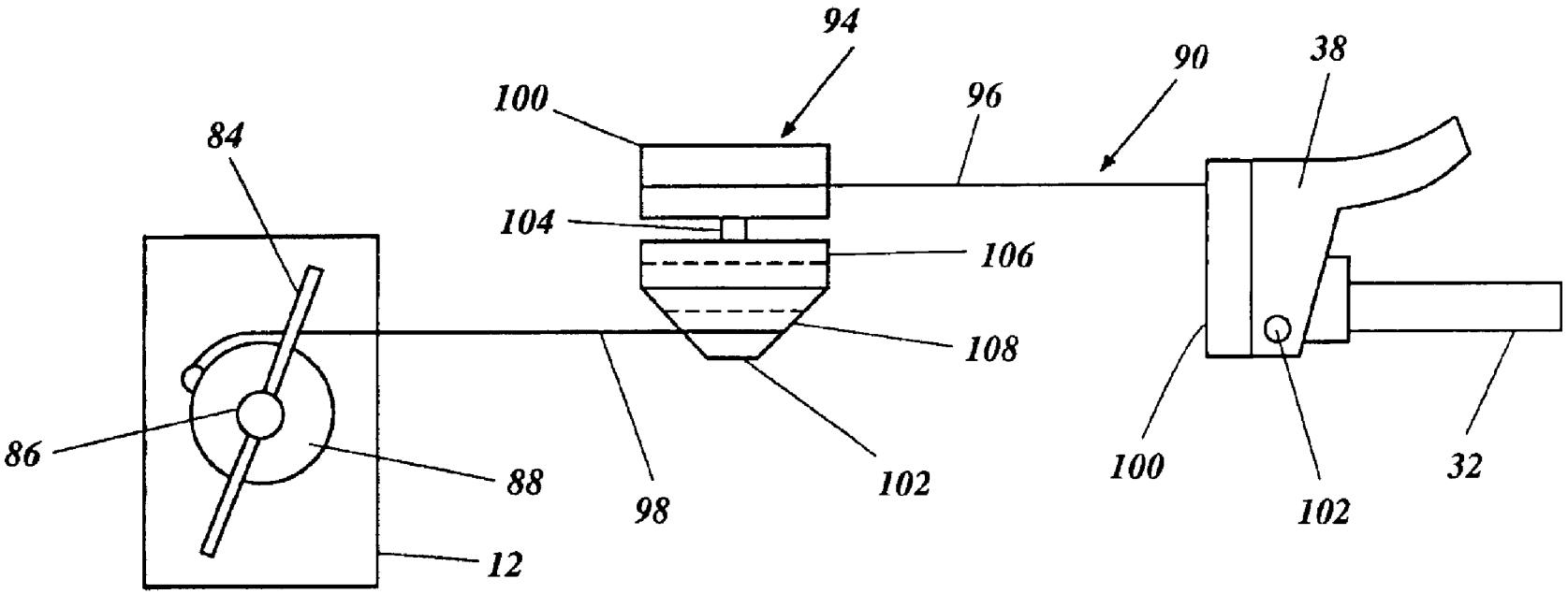
FIG. 3 is a schematic illustration showing the connection of the throttle lever of FIG. 2 with a throttle valve of the engine shown in FIG. 1 and an engine output control device interposed between the throttle lever and the throttle valve.
Figure 4:
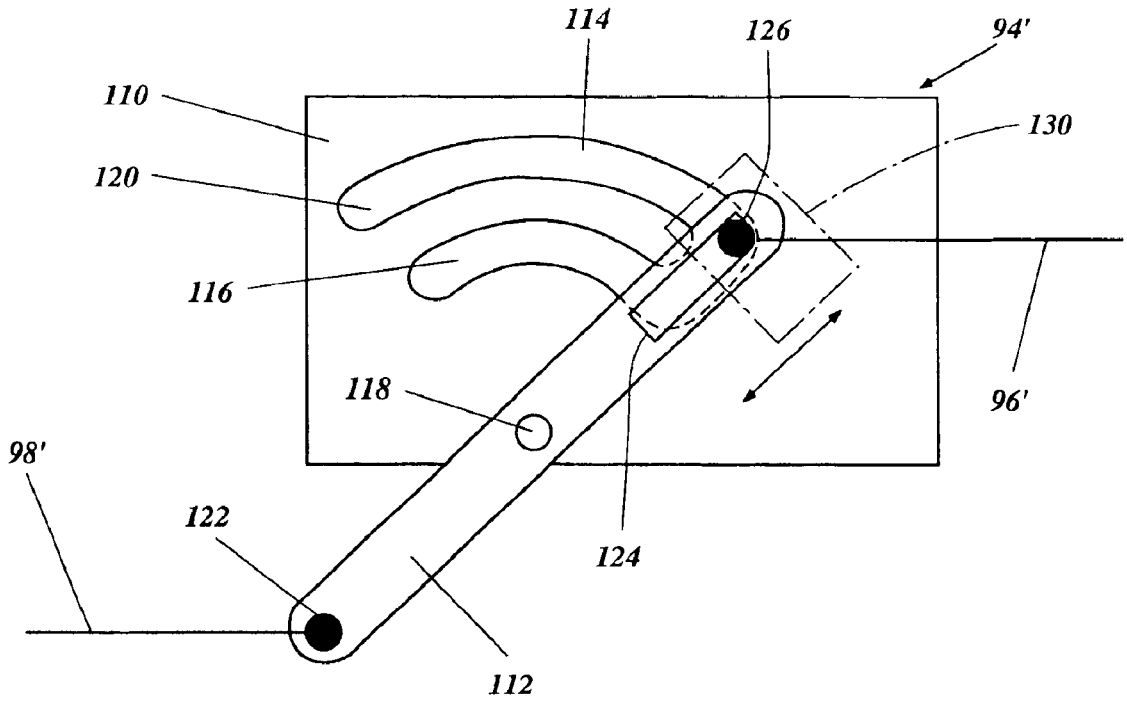
FIG. 4 is a modification of the engine output control device illustrated in FIG. 3.

With reference to FIG. 4, a modification of the engine output control device 94 is illustrated and is referred to generally with the reference numeral 94'. Components of the watercraft 10 illustrated in FIG. 4 which are the same as illustrated in FIGS. 1–3 are identified with the same reference numeral, except that a "'" has been added thereto.

In the illustrated embodiment, the engine output control device 94' comprises a guide plate 110 and a connecting lever 112 pivotally mounted to the guide plate 110. The guide plate 110 includes a groove 114 formed therein. The groove 114 includes a normal operation portion 116 that is arcuate in shape having its center aligned with a pin 118. A regulated operation portion 120 of the groove 114 is also arcuate in shape and has its center at the pin 118. Thus, the radius of curvature of the regulated operation portion 120 is larger than the radius of curvature of the normal operation portion 116.

The connecting lever 112 is pivotally mounted to the guide plate 110 with the pin 118. An output end of the lever 112 is connected to the output line 98' with a pin 122. The pin 122 is connected to a lever 112 in a fixed position.

The input line 96' is connected to the opposite end of the lever 112. This end of the lever 112 includes a slot 124. The input line 96' is connected to the slot 124 with the pin 126. The slot 124 is sized so as to allow the pin 126 to move within the slot 124 along the direction parallel to the longitudinal length of the lever 112.

The engine output control device 94' also includes a switch 130 that is configures to move the pin 126 along the groove 124. In this embodiment, the input and output lines 96', 98' are configured to operate in push and pull modes, i.e., the lines 96' and 98' can be pushed or pulled during operation.

The position of the lever 112 illustrated in FIG. 4 corresponds to an idle position of the throttle valves 84 and the throttle lever 38. Thus, when the throttle lever is moved from the idle position I to the maximum position M, the input line 96' is pushed toward the lever 112, thereby rotating the lever 112 counterclockwise as viewed in FIG. 4.

When the switch 130 is activated so as to position the pin at the inner end of the groove 124, the pin 126 will move along the normal operation portion 116 of the groove 114 as the input line 96' is pushed therethrough. The lines 96', 98', and the throttle shaft pulley 88 are configured such that movement of the throttle lever 38 from the idle position I to the maximum position M will move the throttle shaft pulley 88 from an idle position to a wide open throttle position.

When the switch 130 is activated to move the pin 126 into alignment with the regulated operation portion 120 of the groove 114, the full range of movement of the throttle lever 138 from the position I to the position M, results in a smaller range of movement of the pin 122, and thus the throttle shaft pulley 88 moves through a smaller range motion than that achieved when the pin 126 moves through the normal operation groove 116. Thus, when operated in the regulated mode, an operator can hold the throttle lever 38 at the maximum position M and thereby operate the engine 12 at a speed lower than that of the maximum speed achieved when the pin 126 moves to the normal operation portion 116.

Figure 5:
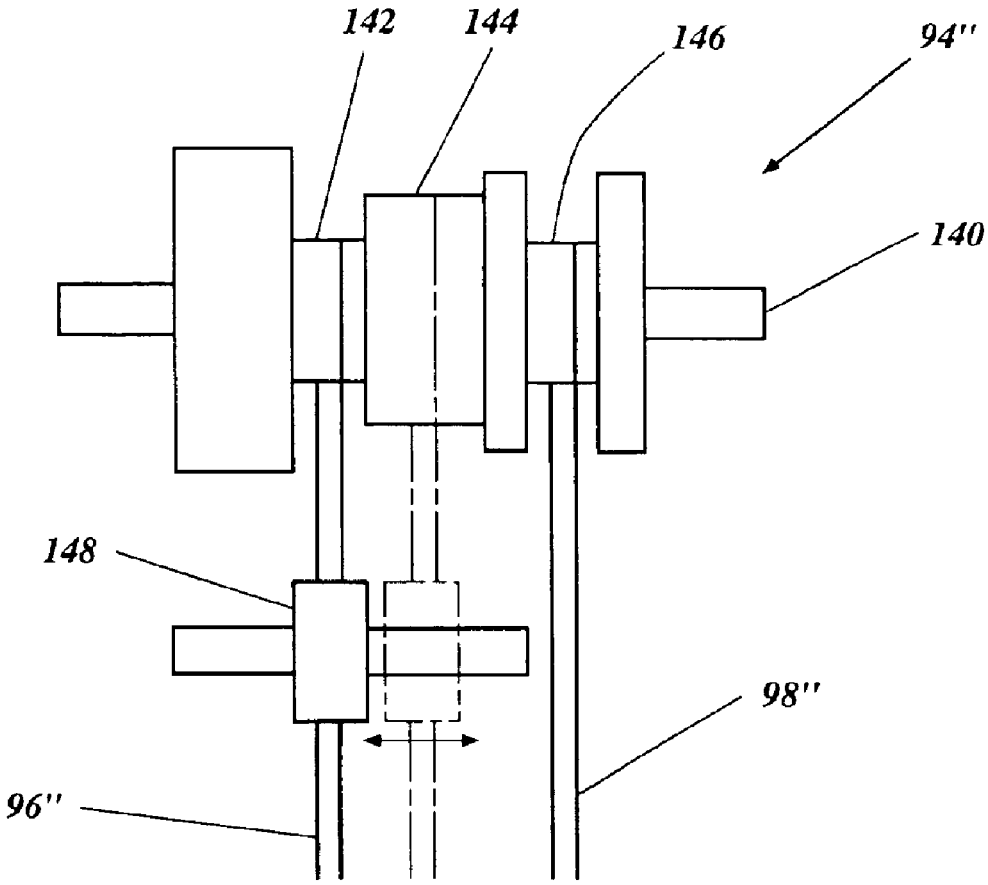
FIG. 5 illustrates another modification of the engine output control device illustrated in FIG. 3.

With reference to FIG. 5, a further modification of the engine output control device 94 is illustrated therein and is identified generally by the reference numeral 94". The components of the watercraft 10 which are the same as those used with the devices 94 and 94' are identified with the same reference numerals, except a "'" has been added thereto.

The engine output control device 94" includes a shaft 140 which supports a plurality of pulleys configured to adjust a ratio of the movement of the input line 96" to the movement of the output line 98". In the illustrated embodiment, the engine output control device 94" includes a normal operation input pulley 142, a regulated operation input pulley 144, and an output pulley 146. Additionally, the device 94" includes a switch 148 for changing a position of the input line 96" relative to the pulleys 142, 144.

The diameters of the pulleys 142, 146 are sized such that when the throttle lever 38 is moved from the idle position I to the maximum position M, thereby moving the input line 96" through a maximum range of motion, the resulting range of motion of the output line 98" moves throttle valves 84 from an idle position to a wide open throttle position.

The diameter of the regulated operation input pulley 144 is larger than the diameter of the output pulley 146. Thus, when the switch 148 moves the input line 96" into contact with the working surface of the regulated operation input pulley 144, the maximum range of motion of the input line 96" causes the upper pulley 146 to rotate through a smaller range of motion than that generated when the input line 96" operates on a normal operation input pulley 142. Thus, when the input line 96" is engaged with the regulated operation input pulley 144, the range of motion of the output line 98" is smaller, and thus, when the throttle lever 38 is moved to the maximum position M, the throttle valves 84 are moved to an intermediate position between the idle position and the right of the throttle position.

With reference to FIG. 6, another modification of the engine output control device 94 is illustrated therein and identified generally by the reference numeral 94'''. The components of the watercraft 10 that are the same or substantially the same as those used with the control devices 94, 94', 94'' are identified with the same reference numerals except that a "'41 " has been added thereto.

The engine output control device 94''' includes an input pulley 150, an input pulley position sensor 152, a throttle valve controller motor 154 and an output pulley 156. The input pulley 150 transforms the linear movement of the input line 96''' into a rotational movement. The input pulley position sensor 152 creates an output signal based on the rotational position of the input pulley 150. In the illustrated embodiment, the input pulley position sensor 152 is in the form of a potentiometer. Thus, the input pulley position sensor 152 generates a signal that represents a rotational position of the input pulley 150, and thus the throttle lever 38.

The potentiometer 152 is connected to a controller. In the illustrated embodiment, the controller can be the ECU 92 which can perform a variety of functions for control of the engine 12 as noted above. Alternatively, the potentiometer 152 can be connected to a separate controller dedicated to the detection of engine output request signals from the throttle lever 38 and for controlling the throttle valves 84 based upon the signal. Alternatively, the controller can be combined with other control devices for controlling various operations of devices on the watercraft 10.

The throttle valve position controller 154 can be in the form of a steppermotor. The steppermotor is connected to the output pulley 156 through a shaft. Thus, rotational movement of the output pulley 156 caused by the steppermotor is translated into a linear displacement of the output line 98'''. The steppermotor 154 is connected to the ECU 92.

The engine output control device 94''' also includes the mode selector device 158. The mode selector 158 can be positioned anywhere on watercraft 10. Preferably, the mode selector 158 is positioned in the vicinity of the operator's area 28, such as, for example, on the control mast 26. Advantageously, the mode selector includes a user-operable switch for allowing an operator to change the operation of the engine output control device 94''' between a normal operation mode and at least one regulated operation mode.

In the normal operation mode, the ECU 92 drives the steppermotor 154 in accordance with the signals received from the potentiometer 152. The throttle lever 38, the input line 96''', the input pulley 150, the output pulley 156, the output line 98''', and the throttle shaft pulley 88 are configured such that in normal operation mode, the maximum range movement of the throttle valve 38 results in the maximum range of movement of the throttle valves 84 between an idle and a wide-open throttle position.

In at least one of the regulated operation modes, as indicated by the mode selector 158, the ECU drives the steppermotor 154 in a different proportion to the signal received from the potentiometer 152, than that used in normal operation. For example, in at least one of the regulated operation modes, the ECU can drive the steppermotor 154 in a smaller proportion to the output signals received from the potentiometer 152. Thus, when the throttle lever 38 is moved to the maximum position M, the throttle valves 84 move to an intermediate position between the idle position and the wide-open valve position.

Optionally, the mode selected 158 can include a plurality of regulated modes allowing the user to choose any number of regulated maximum speeds. Alternatively, the mode selected 158 can be configured to allow infinite adjustment of the regulated maximum speed.

It is to be noted that in all of the embodiments illustrated in FIGS. 1–6 because the engine output control devices 94,94',94'',94''' change the proportional relationship between the movement of the engine output request device (e.g., the throttle lever 38) and the amount of air allowed to enter the combustion chambers of the engine 12, the sensitivity of the engine output request device is reduced when operated in a regulated mode. This provides smoother operation.

For example, often times during operation of a small watercraft, such as a personal watercraft, rough water will cause the watercraft to shake and move up and down abruptly. This can cause the operator to unintentionally move the throttle lever, thereby causing the engine output to fluctuate which causes additional roughness. However, where the sensitivity of the throttle lever is reduced, the unintentional movements of the throttle lever have a smaller effect on the output of the engine. Further, where the operator is holding the throttle lever 38 in the maximum position M, such shaking is less likely to cause such unintentional movement because the operator can keep the throttle lever pressed firmly against the handlebar grip 32.

It is also to be noted that the engine output control devices 94,94',94'',94''' can be mounted anywhere on the watercraft 10, including on the engine 12, or the hull 14, including the rider's area 28.

Although the inventions disclosed herein has been described in terms of certain preferred embodiments, other embodiments apparent to those of ordinary skill in the art are also within the skill of this invention. Accordingly, the scope of the invention is intended to be defined only by the claims that follow.

What is claimed is:

1. A watercraft comprising a hull, the hull defining an operator's area, an engine output request device disposed in the operator's area being movable between a minimum position and a maximum position, an engine supported by the hull, the engine including an engine body defining at least one combustion chamber therein, an air amount control device configured to control an amount of air flowing into the combustion chamber, the air amount control device being operable in at least first and second modes, the air amount control device being configured to, in the first mode, allow a maximum amount of air to flow into the combustion chamber when the engine output request device is positioned in the maximum position, and being configured to, in the second mode, allow an amount of air less than the maximum amount, when the engine output request device is positioned in the maximum position, wherein the air amount control device comprises a throttle valve, the control device being configured to position the throttle valve based on a position of the engine output request device, and additionally comprising a first cable connecting the engine output request device to the control device, and a second cable connecting the control device with the throttle valve, the control device being configured to change a ratio of the movements of the first and second cables when switched between the first and second modes.

2. The watercraft according to claim 1, wherein the engine output request device comprises a throttle lever.

3. The watercraft according to claim 1, wherein the ratio of the movement of the first cable to the movement of the second cable is greater in the second mode than in the first mode.

4. The watercraft according to claim 1 additionally comprising a user operable switch disposed in the operator's area, and configured to allow a user to switch the air amount control device between the first and second modes.

5. The watercraft according to claim 1, wherein the air amount control device comprises a throttle valve and a stepper motor driving the throttle valve.

6. A watercraft comprising a hull, the hull defining an operator's area, an engine output request device disposed in the operator's area being movable between a minimum position and a maximum position, an engine supported by the hull, the engine including an engine body defining at least one combustion chamber therein, an air amount control device configured to control an amount of air flowing into the combustion chamber, the air amount control device being operable in at least first and second modes, the air amount control device being configured to, in the first mode, allow a maximum amount of air to flow into the combustion chamber when the engine output request device is positioned in the maximum position, and being configured to, in the second mode, allow an amount of air less than the maximum amount, when the engine output request device is positioned in the maximum, wherein the air amount control device comprises an input pulley and output pulley, the at least one of the input pulley in the output pulley including at least two portions with different diameters.

7. A watercraft comprising a hull, the hull defining an operator's area, an engine output request device disposed in the operator's area being movable between a minimum position and a maximum position, an engine supported by the hull, the engine including an engine body defining at least one combustion chamber therein, an air amount control device configured to control an amount of air flowing into the combustion chamber, the air amount control device being operable in at least first and second modes, the air amount control device being configured to, in the first mode, allow a maximum amount of air to flow into the combustion chamber when the engine output request device is positioned in the maximum position, and being configured to, in the second mode, allow an amount of air less than the maximum amount, when the engine output request device is positioned in the maximum position, wherein the air amount control device comprises a lever pivotally mounted adjacent at least two grooves, the two grooves being arcuate in shape.

8. An internal combustion engine comprising an engine body defining at least one combustion chamber therein, an engine output request device, a control device configured to control an amount of air flowing into the combustion chamber based on a signal from the engine output request device, and means for changing the relationship between at least a maximum signal from the engine output request device and a maximum amount of air flowing into the combustion chamber, wherein the control device comprises a throttle valve, and additionally comprising a control unit, a first cable connecting the throttle lever to the control unit, and a second cable connecting the throttle valve to the control unit, the control unit including a mechanism for changing a ratio of the movement of the first cable to the movement of the second cable.

9. The engine according to claim 8, wherein the engine output request device is a throttle lever.

10. The engine according to claim 8, wherein the control unit comprises a stepper motor driving the throttle valve.

* * * * *